US010845747B2

(12) United States Patent
Horie

(10) Patent No.: US 10,845,747 B2
(45) Date of Patent: Nov. 24, 2020

(54) FIXING DEVICE WITH MAGNETIC PERMEABILITY DETECTION

(71) Applicant: Hewlett-Packard Development Company, L.P., Spring, TX (US)

(72) Inventor: Takayuki Horie, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/843,484

(22) Filed: Apr. 8, 2020

(65) Prior Publication Data

US 2020/0241459 A1 Jul. 30, 2020

Related U.S. Application Data

(63) Continuation of application No. PCT/KR2018/011919, filed on Oct. 11, 2018.

(30) Foreign Application Priority Data

Oct. 31, 2017 (JP) ..... 2017-210566

(51) Int. Cl.
*G03G 15/20* (2006.01)
*G03G 15/00* (2006.01)

(52) U.S. Cl.
CPC ..... *G03G 15/55* (2013.01); *G03G 15/2017* (2013.01); *G03G 15/2053* (2013.01); *G03G 2215/0016* (2013.01)

(58) Field of Classification Search
CPC ..... G03G 15/55; G03G 15/2053; G03G 15/2017; G03G 15/755; G03G 2215/00143; G03G 2215/0016; G03G 2215/2016; B65G 39/16
USPC ..... 399/33, 165, 329; 474/102; 198/810.01, 198/810.02, 810.03, 810.04
See application file for complete search history.

(56) References Cited

U.S. PATENT DOCUMENTS 3,750,129 A * 7/1973 Takeno ..... G01N 27/82 198/810.02
6,712,200 B2 * 3/2004 Ubaldi ..... B65G 39/16 198/810.01
7,684,716 B2 * 3/2010 Ushiro ..... H05B 6/145 399/33
8,177,051 B2 * 5/2012 Alport ..... B65G 43/02 198/810.02
8,872,076 B2 * 10/2014 Suda ..... H05B 6/145 219/619
8,929,753 B2 * 1/2015 Mine ..... G03G 15/205 399/33
8,991,594 B2 * 3/2015 Nakamura ..... B65G 43/02 198/810.02

(Continued)

FOREIGN PATENT DOCUMENTS

JP 2008-58645 A 3/2008
JP 2009151239 A * 7/2009

(Continued)

*Primary Examiner* — Robert B Beatty
(74) *Attorney, Agent, or Firm* — Jefferson IP Law, LLP

(57) ABSTRACT

A fixing device comprises a heating belt and a magnetic permeability detection device. The heating belt includes an endless belt having a metal layer and a heat source. The magnetic permeability detection device is located adjacent the heating belt to detect a magnetic permeability from the metal layer of the heating belt.

16 Claims, 16 Drawing Sheets

(56) References Cited

U.S. PATENT DOCUMENTS

| | | | | |
|---|---|---|---|---|
| 2006/0219528 | A1* | 10/2006 | Aizawa | G01K 7/36 198/810.03 |
| 2010/0247171 | A1* | 9/2010 | Ono | G03G 15/2057 399/302 |
| 2012/0087681 | A1* | 4/2012 | Suda | H05B 6/145 399/33 |
| 2015/0338802 | A1* | 11/2015 | Okano | G03G 15/2053 399/330 |

FOREIGN PATENT DOCUMENTS

| | | | | | |
|---|---|---|---|---|---|
| JP | 2009-251429 | A | | 10/2009 | |
| JP | 2010002797 | A | * | 1/2010 | |
| JP | 2011-33827 | A | | 2/2011 | |
| JP | 2011-128383 | A | | 6/2011 | |
| JP | 2012-83545 | A | | 4/2012 | |
| JP | 2015-69075 | A | | 4/2015 | |
| JP | 2017-3690 | A | | 1/2017 | |
| JP | 2017-44889 | A | | 3/2017 | |
| KR | 20110120770 | A | * | 11/2011 | |
| WO | WO-9705047 | A1 | * | 2/1997 | B65G 43/02 |
| WO | WO-2019088489 | A1 | * | 5/2019 | G03G 15/2053 |

* cited by examiner

FIXING DEVICE WITH MAGNETIC PERMEABILITY DETECTION

BACKGROUND

Printers, copiers, facsimiles and multifunctional machines integrating these, in which electrophotographic technology is employed, may be equipped with a fixing device for fixing toner onto a recording medium such as a paper sheet by heat and pressure. The fixing device may use an endless belt as a heating rotary body.

DETAILED DESCRIPTION

Figure 1:
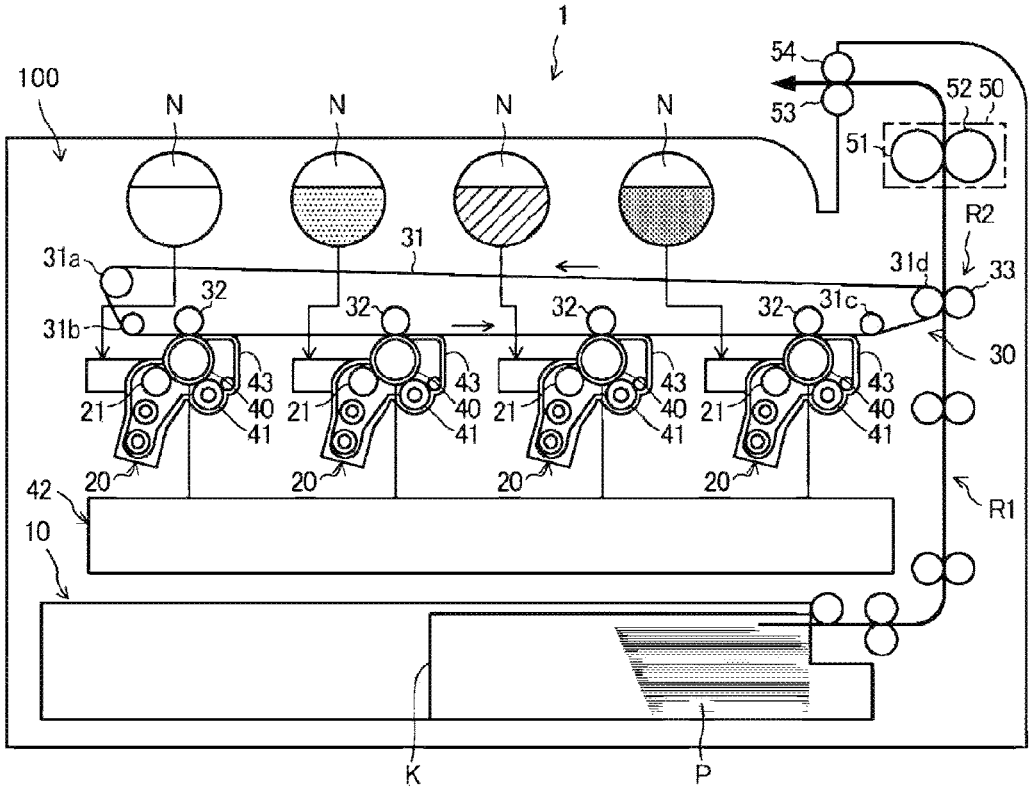
FIG. 1 is a front view showing a schematic construction of an image forming apparatus including an example fixing device.

In the following description, with reference to the drawings, the same reference numbers are assigned to the same components or to similar components having the same function, and overlapping description is omitted.

In fixing devices employing endless belts, the belt may become deformed or deteriorated due to use over time, often stemming from a deviation (bias) of the belt that increases load to one of the edges of the belt.

Some means for detecting deficiencies of the belt do not detect a symptom of failure of the belt in advance; a failure of the belt may be detected from a change in the temperature of the failed belt or from a defect found in a detection image.

Further, a plurality of detection means or a large-scale arrangement may be necessary, which is less suitable for small devices.

Further, where the detection means is to contact the belt, abrasion powder may be generated from the belt or the detection means, and the detection means itself may influence the durability of the belt.

In an optical system where the detection means does not make contact with the belt, dust and dirt may inhibit accurate detection.

In an example fixing device, detection means for detecting magnetic permeability is arranged to face (or positioned in alignment with), in a non-contact manner, a metal layer portion of a heating belt having the metal layer in at least a part thereof, in order to provide a non-contact, simple construction which can detect an anomaly in the heating belt, such as a structural anomaly or an operational anomaly. For example, the fixing device may detect a structural anomaly in a heating belt prior to failure of the heating belt, and/or an operational anomaly such as detecting deviation of the heating belt.

An example fixing device comprises an endless heating belt, a heat source, a pusher member, a pressing rotary body, magnetic permeability detection means (e.g. a magnetic permeability detection device), arithmetic means (e.g. displacement pattern calculation device) and fault determination means (e.g. a fault determination device). The magnetic permeability detection device, the displacement pattern calculation device and/or the fault determination device may comprises processor-readable data and instructions stored on a storage medium. The magnetic permeability detection device, the displacement pattern calculation device and/or the fault determination device may be provided by one or more processor(s), such as one or more microprocessor unit(s) (MPU), for example.

In some examples, the endless heating belt has a metal layer in at least a part thereof. The heat source is capable of heating the heating belt. The pusher member is located in a partial region inside the heating belt and is capable of abutting the heating belt. The pressing rotary body is disposed to abut an outer peripheral surface of the heating belt at a position facing the pusher member for driving the heating belt while capturing a recording medium at a nip formed by pressing the facing surface of the pusher member and for fixing an image formed on the recording medium at the nip. The magnetic permeability detection means are located in a region spaced from the outer peripheral surface of the heating belt and facing the metal layer for detecting magnetic permeability of the heating belt. The arithmetic means are capable of calculating a displacement pattern of magnetic permeability per perimeter of the heating belt based on variations in the magnetic permeability detected by the magnetic permeability detection means. The fault determination means are capable of determining a fault when a current displacement pattern calculated by the arithmetic means is different from the last or other previous displacement patterns. For example, the fault determination means (e.g. the fault determination device) may compare the displacement pattern (e.g. a current displacement pattern) with a previous displacement pattern having been previously calculated, and determine a fault when the current displacement pattern is different from the previous displacement pattern. The fixing device performs an operation upon fault determination when the fault determination means determines a fault. For example, a processor may prompt the operation upon fault determination to be performed when the fault determination device determines the fault. The fault determination device is an example of an anomaly determination device which may compare the current displacement pattern with a previous displacement pattern having been previously calculated, determine an anomaly (e.g. a structural anomaly) in the heating belt, when the current displacement pattern is different from the previous displacement pattern. A processor may prompt an operation to be performed on the heating belt when the anomaly determination device determines the anomaly, for example ceasing an operation of the heating belt.

By means of the magnetic permeability detection means, and the arithmetic means, new and old displacement patterns of magnetic permeability regularly (periodically) measured and calculated may be compared, in order to determine a fault in a non-contact state when the amount of variation is relatively large.

The operation upon fault determination may be an operation to cease the operation of the heating belt.

In the example fixing device, a deformation or damage to the heating belt including the metal layer can be detected earlier, with a simple structure.

In some examples, the fixing device further includes a deviation detection means (e.g. a deviation detection device or a deviation determination device) for detecting the occurrence of deviation of the heating belt when a current displacement pattern calculated by the arithmetic means is different from the last or other previous displacement patterns, and a magnetic permeability detection pattern of metal may be selectively arranged on the heating belt in a detection range of the magnetic permeability detection means, so that an operation upon deviation detection may be performed when the deviation detection means detects that a tolerance range of belt deviation has been exceeded. The deviation detection device or deviation determination device may be provided by one or more processor(s), such as one or more microprocessor unit(s) (MPU), for example. In addition, a processor may prompt the operation upon deviation detection to be performed when the deviation detection means (e.g. deviation detection device or deviation determination device) detects that the deviation of the heating belt has exceeded the tolerance range of belt deviation.

The deviation detection means may be further arranged to carry out detecting the occurrence of deviation of the heating belt based on a displacement pattern according to the selectively arranged magnetic permeability detection pattern of metal, and deviation of the belt can thereby be detected.

An example fixing device includes an endless heating belt, a heat source, a pusher member, a pressing rotary body, magnetic permeability detection means (e.g. a magnetic permeability detection device), arithmetic means (e.g. displacement pattern calculation device), and deviation detection means (e.g. a deviation detection device or a deviation determination device). The magnetic permeability detection device, the displacement pattern calculation device and/or the deviation detection/determination device may comprise processor-readable data and instructions stored on a storage medium. The magnetic permeability detection device, the displacement pattern calculation device and/or the deviation detection/determination device may be provided by one or more processor(s), such as one or more microprocessor unit(s) (MPU), for example.

In some examples, the endless heating belt has a metal layer in at least a part thereof. The heat source is capable of heating the heating belt. The pusher member is located in a partial region inside the heating belt and is capable of abutting the heating belt The pressing rotary body is disposed to abut an outer peripheral surface of the heating belt at a position facing the pusher member for driving the heating belt while capturing a recording medium at a nip formed by pressing the facing surface of the pusher member and for fixing an image formed on the recording medium at the nip. The magnetic permeability detection means are located in a region spaced from the outer peripheral surface of the heating belt and facing the metal layer in order to detect magnetic permeability of the heating belt. The arithmetic means are capable of calculating a displacement pattern of magnetic permeability per perimeter of the heating belt based on variations in the magnetic permeability detected by the magnetic permeability detection means. The deviation detection means are capable of detecting the occurrence of deviation of the heating belt when a current displacement pattern calculated by the arithmetic means is different from the last or other previous displacement patterns. For example, the deviation detection means (e.g. deviation detection device or a deviation determination device) may compare the displacement pattern (e.g. a current displacement pattern) with a previous displacement pattern having been previously calculated, and detect a deviation of the heating belt when the current displacement pattern is different from the previous displacement pattern. A magnetic permeability detection pattern of metal may be selectively arranged on the heating belt in a detection range of the magnetic permeability detection means. An operation upon deviation detection is performed when the deviation detection means detects that a tolerance range of belt deviation has been exceeded. For example, the processor may prompt the operation upon deviation detection, to be performed when the deviation detection device detects that the deviation of the heating belt has exceeded a tolerance range of belt deviation. The deviation detection device is an example of an anomaly determination device which may compare the current displacement pattern with a previous displacement pattern having been previously calculated, determine an anomaly in the heating belt (e.g. an operational anomaly such as a deviation of the heating belt), when the current displacement pattern is different from the previous displacement pattern. A processor may prompt an operation to be performed on the heating belt when the anomaly determination device determines the anomaly, for example correcting an alignment of the heating belt.

By means of the magnetic permeability detection means, the arithmetic means, and the deviation detection means that detect the occurrence of deviation of the heating belt from new and old displacement patterns of magnetic permeability, displacement patterns of magnetic permeability regularly (periodically) measured and extracted may be compared, in order to detect deviation of the heating belt in a non-contact state when the amount of variation has exceeded a tolerance range.

In some examples, the deviation detection means may cease the operation of the heating belt when it is determined that the amount of variation in the magnetic permeability of the heating belt has deviated from a predetermined range during rotation.

Accordingly, the heating belt can be stopped before the heating belt is deformed or damaged beyond an acceptable or operational state.

The magnetic permeability detection pattern of metal may be a pattern having a varying thickness in the widthwise direction of the heating belt.

Accordingly, the amount of variation in the displacement pattern of magnetic permeability changes depending upon the position of the detection pattern, and deviation of the heating belt can be readily and reliably detected.

The deviation detection means may cease the operation of the heating belt when it is determined that the cycle of variation in the magnetic permeability of the heating belt has deviated from a predetermined cycle during rotation.

Accordingly, the heating belt can also be stopped before the heating belt is severely damaged.

The magnetic permeability detection pattern of metal may be a pattern having a varying spacing or area in the widthwise direction of the heating belt.

Accordingly, the displacement pattern of magnetic permeability may change depending upon the position of the detection pattern, and deviation of the belt can be detected.

In some examples, the fixing device may further include deviation correction means (e.g. a deviation correction device) for correcting deviation of the heating belt when the deviation detection means determines that the amount of variation or the cycle of variation in the magnetic permeability of the heating belt has deviated from a predetermined range. The deviation correction device may comprise processor-readable data and instructions stored on a storage medium. The deviation correction device may be provided by one or more processor(s), such as one or more microprocessor unit(s) (MPU), for example.

Accordingly, a deviation of the belt can be corrected without stopping the heating belt.

In some examples, the deviation correction means may be load adjustment means (e.g. load adjustment device) for adjusting, in a direction in which the heating belt faces the pressing rotary body, a load applied to at least one of support members that support the heating belt at their edges.

Accordingly, the deviation of the belt can be corrected without stopping the heating belt.

In some examples, the deviation correction means may include alignment adjustment means (alignment adjustment device) for adjusting an alignment position between a center of rotation of the heating belt and a rotation axis of the pressing rotary body by applying pressure to at least one of support members that support the heating belt at its edges.

Accordingly, a deviation of the belt can be corrected without stopping the heating belt.

In some examples, the deviation correction means may be temperature adjustment means (e.g. temperature adjustment device) for locally adjusting the temperature of the heating belt.

Accordingly, a deviation of the belt can be reliably corrected without stopping the heating belt.

Example fixing devices include a heating belt having a metal layer in at least a part thereof, in order to detect a structural anomaly in the belt prior to failure of the heating belt and to detect a deviation of the heating belt, in a non-contact, simple construction.

FIG. 1 represents a schematic construction (lateral structure) of an example image forming apparatus (e.g., printer) including an example fixing device.

Overall Structure of Image Forming Apparatus

The example image forming apparatus 1 is an apparatus to form color images using, for example, magenta, yellow, cyan and black colors. As shown in FIG. 1, the image forming apparatus 1 includes an image forming section 100 and forms an image on a paper sheet (recording medium) P.

The image forming section 100 may have a recording medium conveyance unit 10 for conveying a paper sheet P, developing devices 20 for developing electrostatic latent images, a transfer unit 30 for secondarily transferring a toner image to the paper sheet P, photosensitive drums 40 that are electrostatic latent image carriers, on circumferential surfaces of which images are formed, and a fixing device 50 for fixing the toner image onto the paper sheet P.

The recording medium conveyance unit 10 conveys a paper sheet P to be formed with an image along a conveyance path R1. The paper sheet P is stacked and contained in a cassette K, picked up one by one by a paper feed roller and conveyed.

Four developing devices 20 are provided for the respective colors. Each of the developing devices 20 is provided with a developer roll 21 for carrying toner to the photosensitive drum 40. In the developing device 20, toner and carrier are adjusted to have a desired mixing ratio, and mixed and stirred for uniformly dispersing the toner to prepare a developer imparted with an optimal amount of charge.

The developer is carried by the developer roll 21. Then, as the developer roll 21 rotates to carry the developer to a region facing the photosensitive drum 40, toner is moved out of the developer carried on the developer roll 21 and onto an electrostatic latent image formed on a circumferential surface of the photosensitive drum 40 to develop the electrostatic latent image.

The transfer unit 30 carries the toner image formed with the developing device 20 to the secondary transfer region R2 for secondary transfer to the paper sheet P. The transfer unit 30 is provided with a transfer belt 31, support rollers 31*a*, 31*b*, 31*c* and 31*d* for supporting the transfer belt 31, primary transfer rollers 32 for holding the transfer belt 31 with the photosensitive drums 40, and a secondary transfer roller 33 for holding the transfer belt with the support roller 31*d*. The transfer belt 31 is an endless belt that is circularly moved by the support rollers 31*a*, 31*b*, 31*c* and 31*d*.

Four photosensitive drums 40 are provided for the respective colors. Each of the photosensitive drums 40 is provided along the direction of movement of the transfer belt 31. Around the circumference of the photosensitive drum 40, the developing device 20, a charge roller 41, an exposure unit 42 and a cleaning unit 43 are arranged.

The charge roller 41 includes charge means for uniformly charging the surface of the photosensitive drum 40 at a predetermined potential. The charge roller 41 is moved to follow the rotation of the photosensitive drum 40. The exposure unit 42 exposes the surface of the photosensitive drum 40 charged by the charge roller 41 in accordance with an image to be formed on the paper sheet P. The potential of portions of the surface of the photosensitive drum 40 exposed by the exposure unit 42 is thereby changed to form an electrostatic latent image.

The four developing devices 20 each uses the toner supplied from a toner tank N provided opposite the developing device 20 to develop the electrostatic latent image formed on the photosensitive drum 40 and creates a toner image. The cleaning unit 43 collects toner remaining on the photosensitive drum 40 after the toner image formed on the photosensitive drum 40 is primarily transferred to the transfer belt 31.

The fixing unit 50 adheres and fixes onto the paper sheet P, the toner image that has been secondary transferred from the transfer belt 31 to the paper sheet P. The fixing unit 50 is provided with a heating belt (fixing belt) 51 for heating the paper sheet P and a pressure roll 52 for pressing the heating belt 51. The pressure roll 52 is an example of the pressing rotary body. The heating belt 51 and the pressure roll 52 are formed in cylindrical shapes, and the heating belt 51 is internally provided with a heat source such as a halogen lamp, as later described. A nip is provided as a contact area between the heating belt 51 and the pressure roll 52. The toner image can be fused and fixed onto the paper sheet P when the paper sheet P is passed through the nip. After the toner image has been secondary transferred onto the paper sheet P, the toner remaining on the transfer belt 31 is collected by the belt cleaning device.

The image forming apparatus 1 is provided with discharge rollers 53 and 54 for discharging the paper sheet P on which the toner image is fixed by the fixing device 50 to the outside of the apparatus.

Construction of Example Fixing Device

A construction (configuration) of an example fixing device will be described with reference to the drawings.

Figure 2:
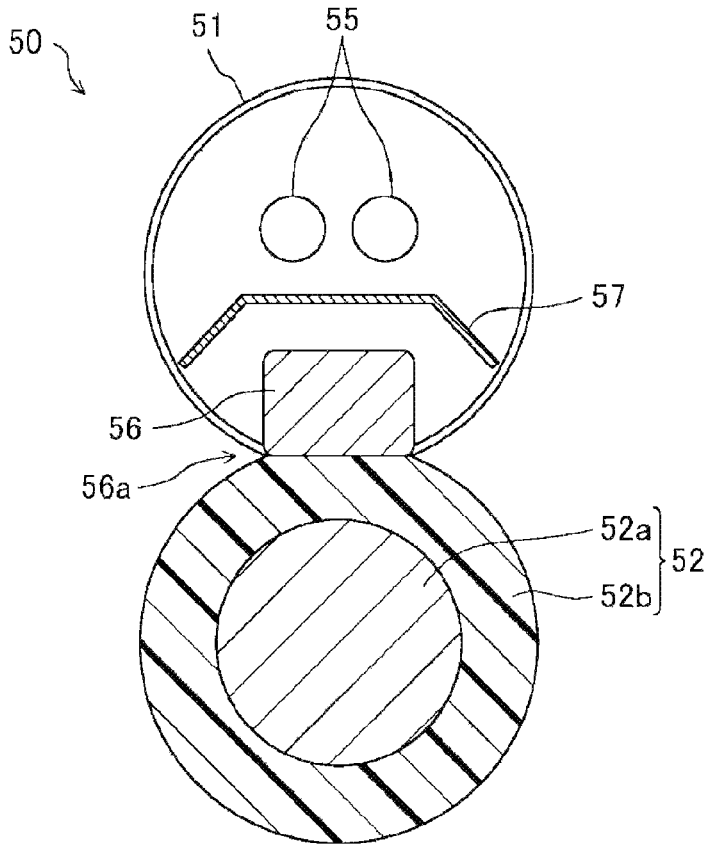
FIG. 2 is a cross-sectional view taken along II-II line in FIG. 3, showing an example fixing device.

FIG. 2 shows a cross-sectional structure of the example fixing device 50. The heating belt 51 is cylindrical, i.e., an endless belt. A heat source for heating the heating belt 51, such as halogen lamps 55, is located inside the heating belt 51 in a non-contact state. In a partial region inside the heating belt 51, a nip forming member 56 is disposed as the pusher member capable of abutting the heating belt 51. Further, a reflector plate 57 is located inside the heating belt 51 in a manner to cover the nip forming member 56. The reflector plate 57 is provided to reflect the radiation heat from the halogen lamps 55 toward the belt. In some other examples, the heat source may have a construction to heat the heating belt 51 from the outside of the heating belt.

The heating belt 51 may be composed of, for example, a base layer, an intermediate layer, and a surface layer, in the order from the bottom. The base layer may be made of, for example, stainless or nickel. The intermediate layer may be made of, for example, silicone rubber. The surface layer may be made of, for example, a fluorine resin. The fluorine resin may prevent adherence of the recording medium or paper sheet. An aluminum material having a surface coated with a fluorine resin, for example, may be used for the nip forming member 56. With the fluorine resin coating, the friction generated between the nip forming member 56 and the inner peripheral surface of the heating belt 51 can be reduced.

The pressure roll 52 is disposed to abut an outer peripheral surface of the heating belt 51 at a position facing the nip forming member 56.

The pressure roll 52 may comprise, for example, an inner core metal 52*a*, and an elastic body 52*b* surrounding the outer circumferential surface of the core metal 52*a*.

The pressure roll 52 drives the heating belt while capturing the paper sheet at the nip 56*a* on the outer peripheral surface of the heating belt 51 formed by pressing the surface of the nip forming member 56 (e.g. by pressing the pressure roll 52 against the surface of the nip forming member 56 that faces the pressure roll 52). Then, the image electrostatically coated on the paper sheet is fused and fixed at the nip 56*a*, due to the heat produced from the heating belt 51 and the pressure from the pressure roll 52.

Method for Detecting Failure of Heating Belt

An example method for detecting failure of the heating belt in the example fixing device will now be described with reference to the drawings.

Figure 3:
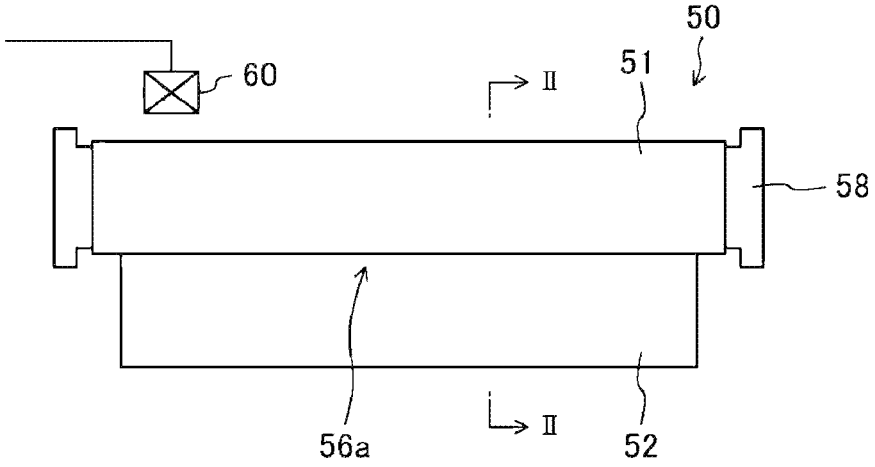
FIG. 3 is a plan view showing the example fixing device.

FIG. 3 schematically shows a planar construction in which a magnetic permeability sensor 60 which can detect failure of the heating belt 51 in a non-contact and non-optical manner is arranged at one of the edges of the heating belt 51 in the example fixing device 50. The magnetic permeability sensor 60 is an example of the magnetic permeability detection means. The magnetic permeability sensor 60 detects the magnetic permeability of the heating belt 51 while it is rotationally operating. The heating belt 51 is slidably supported by support members 58 at the inner peripheral surfaces of the respective edges. The support member 58 may be formed of, for example, a liquid crystal polymer (LCP) resin.

It should be noted that, while stainless or the like metal may be used, in examples disclosed herein, as the base layer of the heating belt 51 throughout the entire periphery of the heating belt 51, a non-metal member such as a resin material or the like may be used for the base layer. It may be necessary to provide a metal member, such as a sheet metal member, to the heating belt 51 in the detection range of the magnetic permeability sensor 60.

Figure 4:
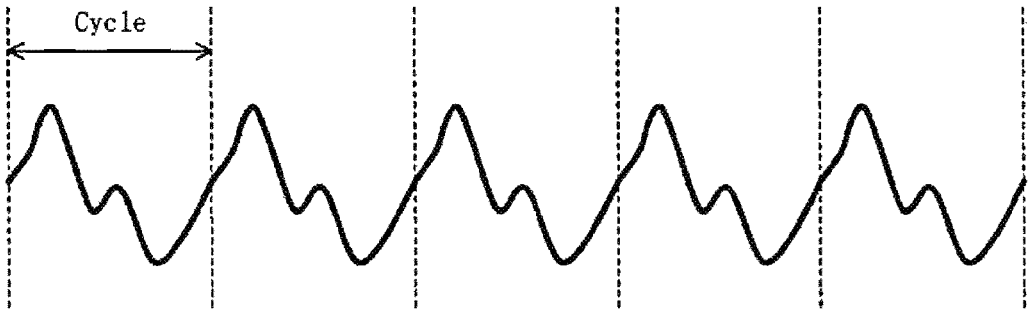
FIG. 4 is a diagrammatic graph showing a normal displacement pattern of magnetic permeability detected from the heating belt in the example fixing device.

As shown in FIG. 4, as the heating belt 51 rotates, the position of the belt varies in a cycle of the belt perimeter. The presence or absence of rotation of the heating belt 51 may be detected by sensing this cyclic variation.

Further, a displacement pattern per cycle of a normal belt, i.e., the heating belt 51 not associated with any deficiency, may be stored in a memory device, and may be compared with the detected displacement pattern of magnetic permeability.

Figure 5:
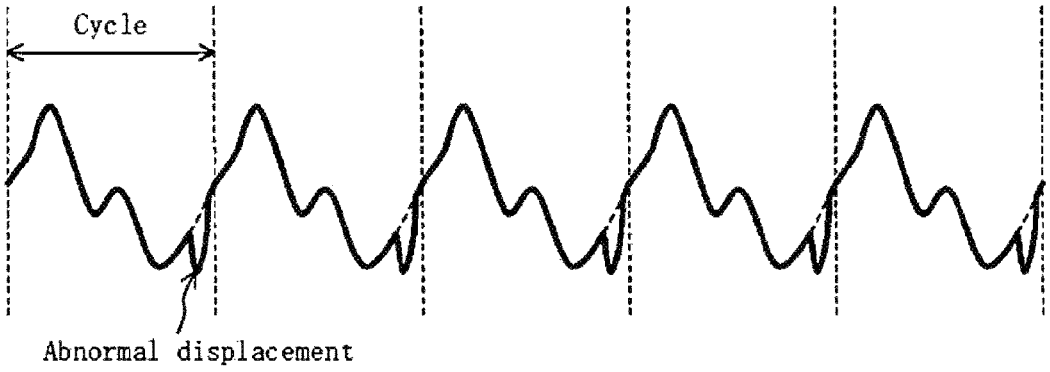
FIG. 5 is a diagrammatic graph showing an abnormal displacement pattern of magnetic permeability detected from the heating belt in the example fixing device.

As shown in FIG. 5, when the heating belt 51 is deformed due to changes over time or the like, an abnormal displacement may be detected in a displacement pattern of magnetic permeability. Consequently, a fault in the heating belt 51 can be detected before the heating belt 51 fails.

Figure 6:
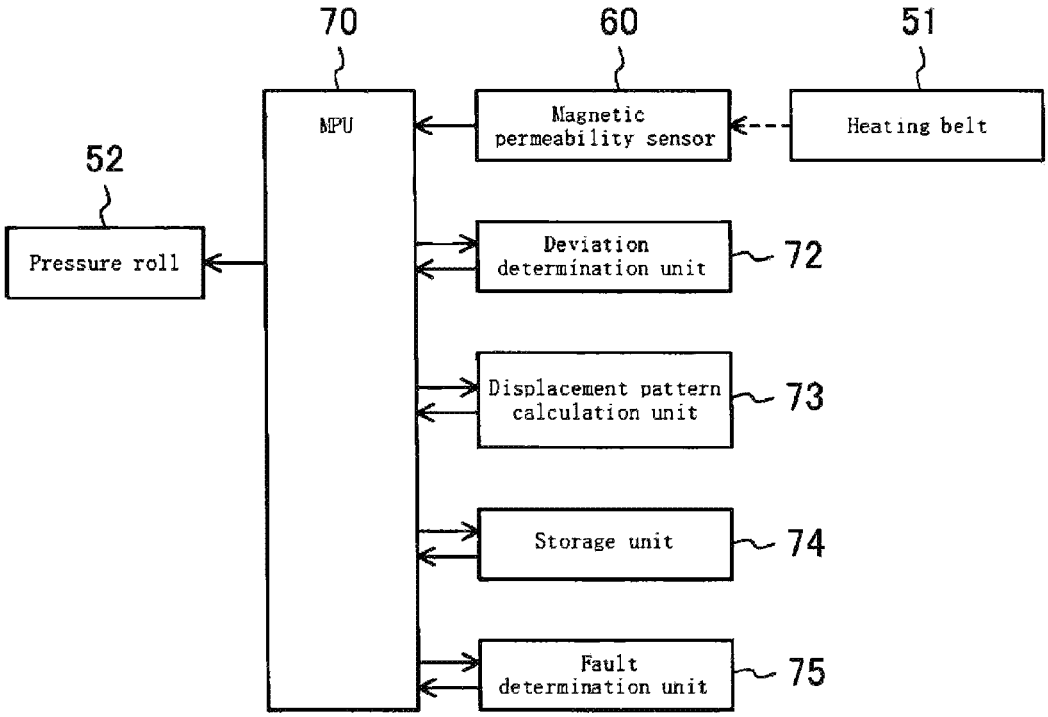
FIG. 6 is a functional block diagram showing functions for realizing the detection of a failure of the heating belt in the example fixing device.

FIG. 6 shows an example functional block diagram for realizing a fault detection in the example heating belt.

The magnetic permeability sensor 60 is connected to, for example, a microprocessor unit (MPU) 70 including a processor, that receives signals from a plurality of component elements and controls the respective component elements. A variation determination unit (or variation determination device, or deviation determination unit) 72 determines a variation in the magnetic permeability of the rotating heating belt 51 detected with the magnetic permeability sensor 60. This is used in either the case of FIG. 4 or FIG. 5. A displacement pattern calculation unit 73 (e.g. displacement pattern calculation device) calculates, through arithmetic operations, a displacement pattern of magnetic permeability per perimeter (per cycle) of the heating belt 51 from the variation in the magnetic permeability determined by the variation determination unit 72. The arithmetic operations may be carried out by a processor that executes processor-readable instructions. A storage unit 74 including a memory device stores a current displacement pattern calculated by the displacement pattern calculation unit 73. A fault determination unit (e.g. a fault determination device) 75 determines a fault when the current displacement pattern calculated by the displacement pattern calculation unit 73 is different from the last or other previous displacement patterns stored in the storage unit 74. The variation determination unit or device 72, the displacement pattern calculation device/unit 73, and/or the fault determination unit/device 75 may be provided by a processor (e.g. MPU 70) to execute processor-readable instructions. The variation determination device (or deviation determination unit) 72 and the fault determination device 75 are examples of anomaly determination devices.

When, for example, the fault determination unit 75 detects an abnormal displacement shown in FIG. 5, the operation of the fixing device 50 is ceased. For example, the driving of the pressure roll 52 is stopped through the MPU 70.

According to examples, as the heating belt 51 has a metal layer at least in the detection range of the magnetic permeability sensor 60, an anomaly in the metal layer can be detected more promptly even if a resin coating is provided as the surface layer. For example, a deficiency or deformation of the heating belt 51 can be detected in an earlier stage. Consequently, the fixing device 50 may be stopped without propagating deformation or damage caused by the fault in the heating belt 51 to other units.

An example fixing device enabled for detection, and an example method for detecting deviation of a heating belt will now be described with reference to the drawings. In the following, the same reference signs are used for the component parts or component elements described in the example of FIGS. 2 to 5, to omit detailed explanations thereof.

Construction of Heating Belt

Figure 7:
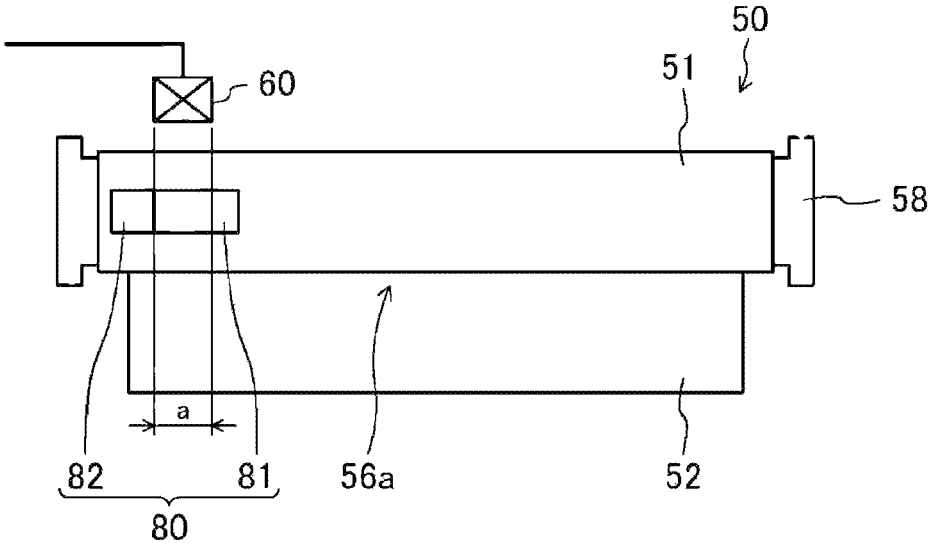
FIG. 7 is a plan view showing an example fixing device.

FIG. 7 schematically shows a planar construction of the heating belt 51 and the pressure roll 52 according to the present example.

In the heating belt 51, a magnetic permeability detection pattern 80 of metal is selectively arranged at one of the edges of the heating belt 51. Specifically, the magnetic permeability detection pattern 80 is arranged to extend across a detection range (a) of the magnetic permeability sensor 60 and its periphery. The magnetic permeability detection pattern 80 comprises a first metal chip 81 and a second metal chip 82 having different thicknesses and different magnetic permeabilities.

Figure 8A:
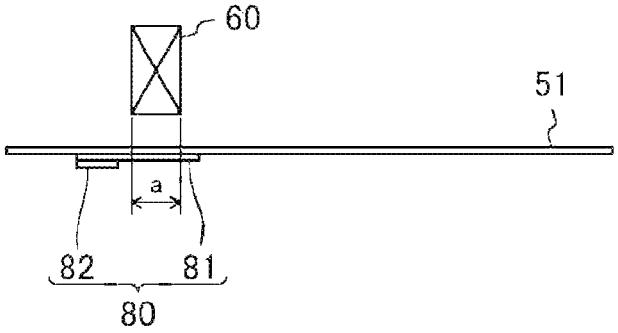
FIG. 8A is a schematic cross-sectional view of a case where magnetic permeability is detected in a normal belt position in the example fixing device.

As shown in FIG. 8A, the first metal chip 81 is located in the magnetic permeability detection range (a) and the second metal chip 82 is located in the outside (edge side of the belt) of the detection range (a). Further, the thickness of the first metal chip 81 is set thinner than the second metal chip 82. Each of the metal chips 81 and 82 may, for example, be made of nickel.

The magnetic permeability between the first metal chip 81 and the second metal chip 82 may be different, and the type of metal of one of them may be different. For example, one may be made of nickel and the other may be made of SUS (stainless steel), and so on.

Method for Detecting Deviation of Heating Belt

Figure 8B:
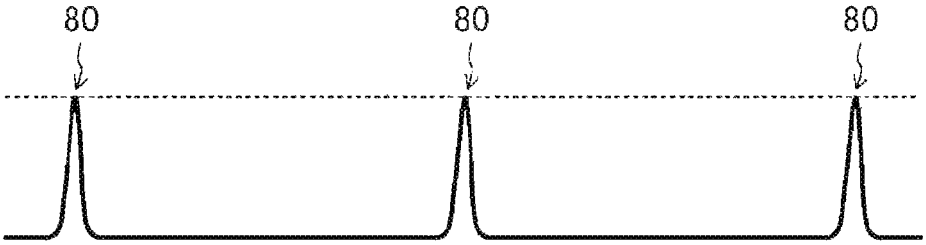
FIG. 8B is a diagrammatic graph showing a displacement pattern of magnetic permeability in that case.

As shown in FIG. 8B, when the heating belt 51 having the aforementioned constructions is rotated, the magnetic permeability of the magnetic permeability detection pattern 80 can be detected in a cycle attributable to the first metal chip 81. It should be noted that, in FIG. 8B, the displacement pattern is depicted by way of characteristic portions of the magnetic permeability and detailed displacement patterns as shown in FIG. 4 are omitted. This is also the case for other drawings after FIG. 8B.

Figure 9A:
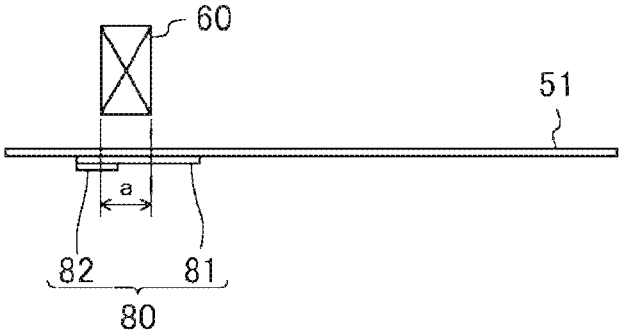
FIG. 9A is a schematic cross-sectional view of a case where magnetic permeability is detected in a belt position deviated to the right side in the example fixing device.
Figure 9B:
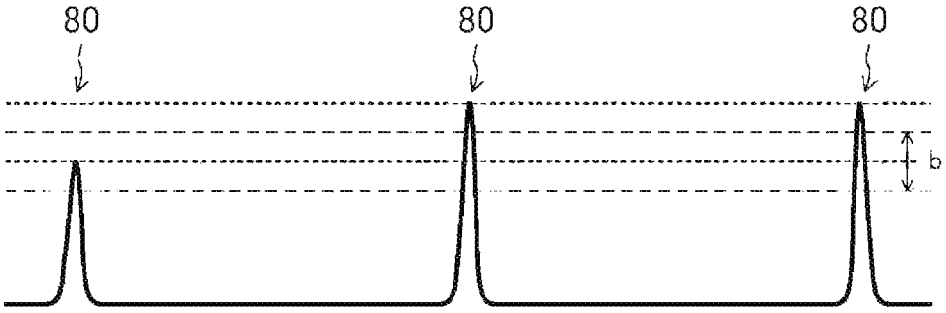
FIG. 9B is a diagrammatic graph showing a displacement pattern of magnetic permeability in that case.

As shown in FIG. 9A, when the heating belt 51 is deviated to the right side and the first metal chip 81 and the second metal chip 82 are both situated in the detection range (a) for magnetic permeability, a magnetic permeability higher than normal is detected, as shown in FIG. 9B. Accordingly, it can be detected that the heating belt 51 has deviated to the right side. In the case of FIG. 9B, the deviation of the heating belt 51 to the right side is detected as it has exceeded an upper limit of a tolerance range (b) for the deviation of the heating belt 51.

Figure 10A:
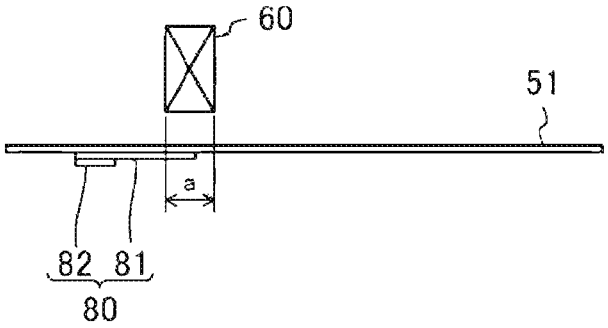
FIG. 10A is a schematic cross-sectional structure of a case where magnetic permeability is detected in a belt position deviated to the left side in the example fixing device.
Figure 10B:
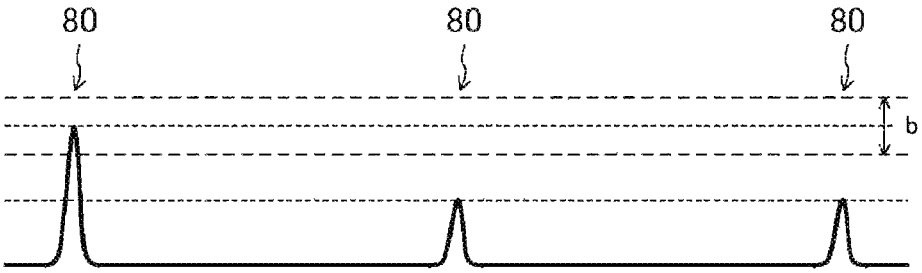
FIG. 10B is a diagrammatic graph showing a displacement pattern of magnetic permeability in that case.

Further, as shown in FIG. 10A, when the heating belt 51 is deviated to the left side into a position where the first metal chip 81 is not located in the detection range (a) for magnetic permeability, a magnetic permeability lower than normal is detected. Accordingly, it can be detected that the heating belt 51 has deviated to the left side. In the case of FIG. 10B, the deviation of the heating belt 51 to the left side is detected as it has fallen below a lower limit of the tolerance range (b) for the deviation of the heating belt 51.

As described above, the example fixing device 50 is capable of ceasing the operation of the heating belt 51 based on a detected magnetic permeability.

Further, the example fixing device 50 is also capable of correcting deviation of the heating belt 51 based on a detected magnetic permeability, and can thus reduce back the load applied to the heating belt 51.

Method for Correcting Deviation of Belt

An example method for correcting deviation of the heating belt 51 will now be described, with reference to FIG. 11.

Figure 11:
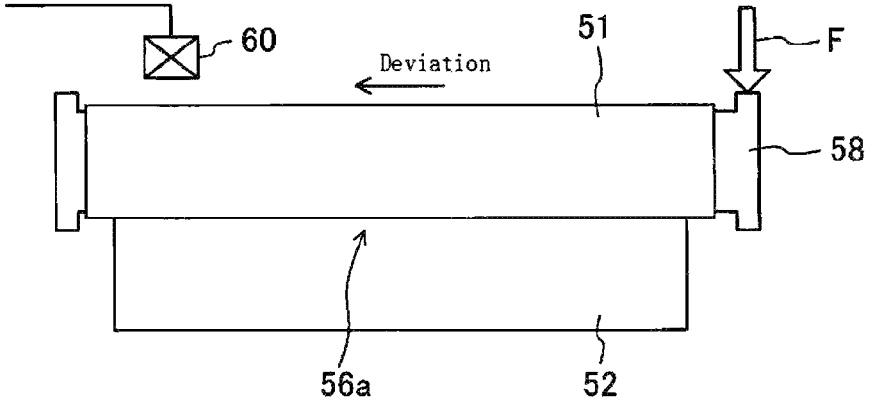
FIG. 11 is a schematic front view showing a method for correcting deviation of the heating belt in the example fixing device.

As shown in the front view of FIG. 11, at least one of the two support members 58 to support the edges of the heating belt 51 is provided with a load adjustment unit 77 (see FIG. 15) for adjusting a load F applied in a direction in which the heating belt 51 faces the pressure roll 52. The load adjustment unit 77 is an example of the load adjustment means. The adjustment unit 77 may, for example, have a mechanism in which one end of a rod-like pusher member abuts against the support member 58 and the other end is driven back and forth by a motor for adjusting the load F.

For example, when the heating belt 51 is deviated to the left side, the load F applied by the load adjustment unit 77 is increased. Accordingly, the heating belt 51 can be moved to the right side. When the heating belt 51 deviates to the right side, the load F applied by the load adjustment unit 77 can be decreased for moving the heating belt 51 to the left side. Such processing for increasing and decreasing the load F may also be made if the load adjustment unit 77 is provided to each of the support members 58.

Figure 13:
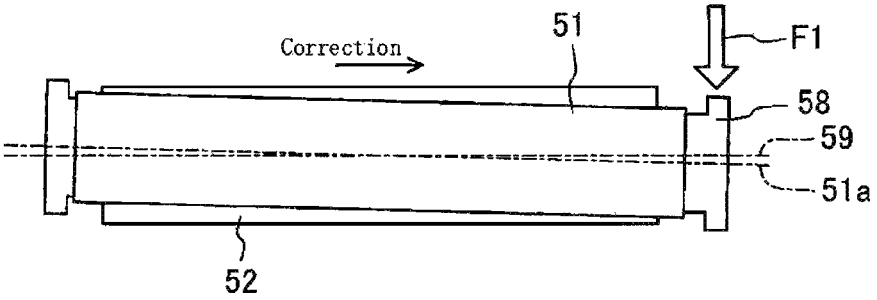
FIG. 13 is a schematic plan view showing a modified example of the method for correcting deviation of the heating belt in the example fixing device.
Figure 15:
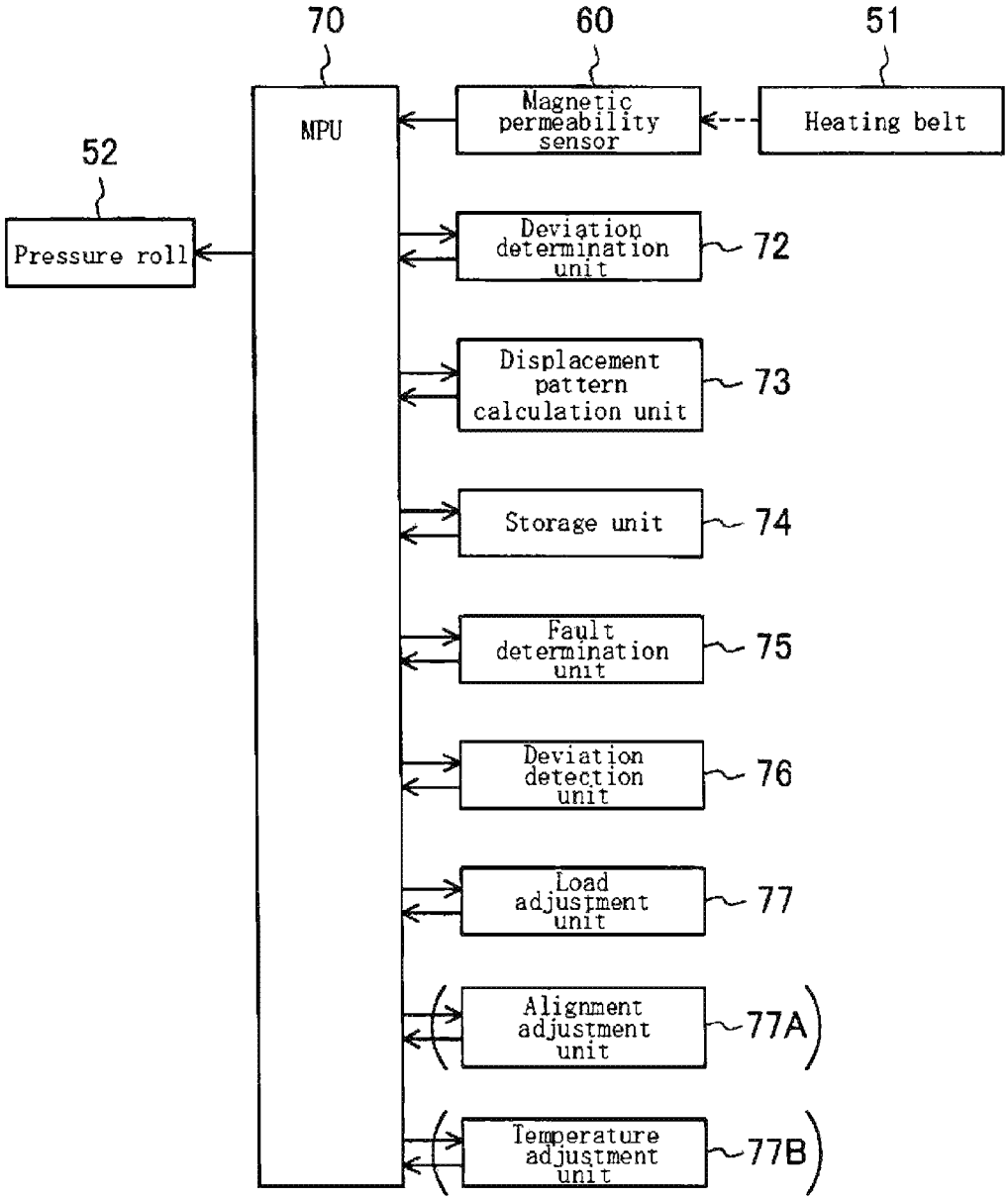
FIG. 15 is a functional block diagram showing functions for realizing the detection of deviation and correction of deviation of the heating belt in the example fixing device.

In a modified example of the deviation correction means (or deviation correction device), the load adjustment unit 77 may be replaced with an alignment adjustment unit 77A shown in FIG. 13 and FIG. 15. The alignment adjustment unit 77A is an example of the alignment adjustment means. The alignment adjustment unit 77A of the heating belt 51 may apply pressure to, for example, at least one of the support members 58 of the heating belt 51. With the applied pressure, an alignment position 59 between a center of rotation of the heating belt 51 and a rotation axis of the pressure roll 52 can be adjusted (altered).

Figure 12:
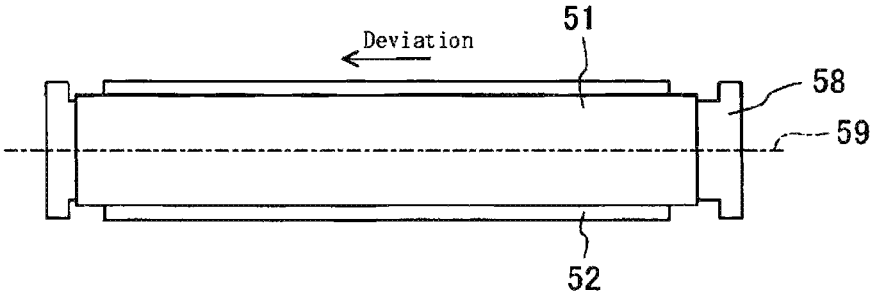
FIG. 12 is a schematic plan view showing a modified example of the method for correcting deviation of the heating belt in the example fixing device.

Specifically, during a normal operation in which the heating belt 51 is not deviated, the heating belt 51 and the pressure roll 52 are disposed to have aligned centers of rotations (see FIG. 12). This state is referred to as a stated in which the alignment between the heating belt 51 and the pressure roll 52 is agreed (matched). In this modified example, deviation of the heating belt 51 can be corrected by appropriately shifting the center of rotation of the heating belt 51 relative to the center of rotation (rotation axis) of the pressure roll 52. For example, FIG. 12 is a planar construction viewed from above the heating belt 51, showing a state in which the heating belt 51 is deviated to the left side. In this case, the alignment position 59 has yet to be adjusted (altered). FIG. 13 shows a state in which a load F1 is applied to the support member 58 on the right side such that the alignment position 59 is shifted to an alignment adjusted position 51*a*. This causes the heating belt 51 to return to the right side and the deviation of the heating belt 51 can be corrected. The alignment adjustment unit 77A may be provided to the support member 58 on the left side, or it may be provided to each of the support members 58. Further, the alignment adjustment unit 77A may be provided to the pressure roll 52.

Figure 14:
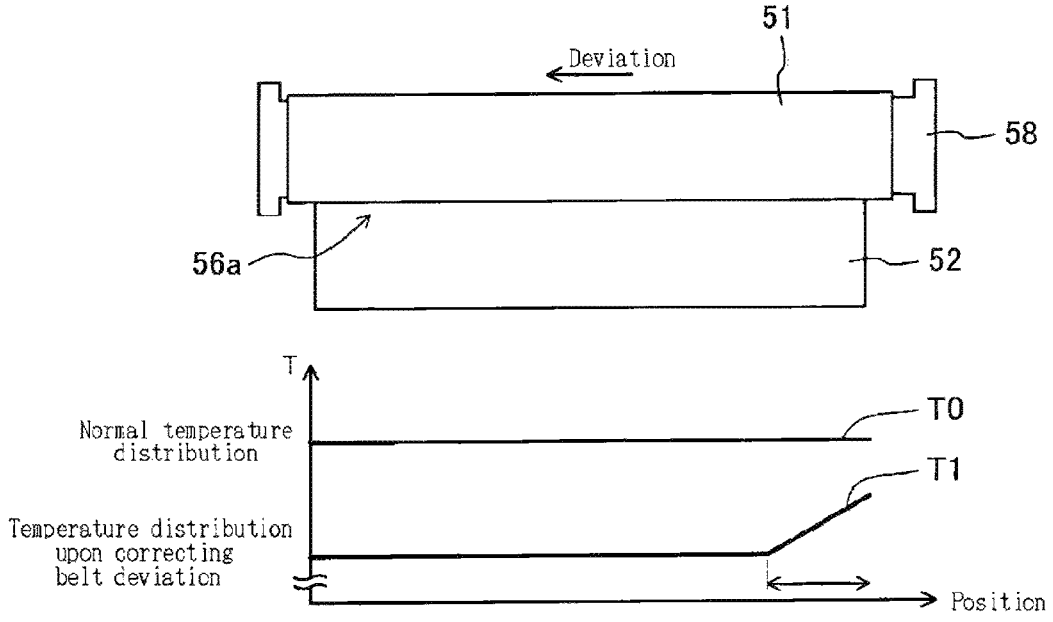
FIG. 14 is a schematic plan view showing another modified example of the method for correcting deviation of the heating belt in example the fixing device.

In another modified example, the deviation correction means may be a temperature adjustment unit 77B shown in FIG. 14 and FIG. 15. The temperature adjustment unit 77B is an example of the temperature adjustment means. As shown in FIG. 14, the temperature adjustment unit 77B may adjust the temperature of the heating belt 51 depending on the position along the center of rotation thereof, thereby imparting a local temperature difference to the heating belt 51. For example, when adjustment is made such that the temperature of one of the edges (right edge in FIG. 14) of the heating belt 51 is increased locally (temperature T1 in FIG. 14), an edge of the elastic body constituting the pressure roll 52 expands to increase its diameter by a degree corresponding to a temperature difference from the temperature during a normal operation (temperature T0 in FIG. 14). As a result, a difference in speed arises, attributable to the roll diameter of the portion of the pressure roll 52 having the increased diameter, and the deviation of the heating belt 51 can be corrected. In this case, heating means for the temperature adjustment may be, for example, a halogen lamp which can locally heat the heating belt 51.

FIG. 15 shows an example function block for realizing the detection of deviation of the heating belt 51.

As shown in FIG. 15, the functional block diagram represents a configuration in which a deviation detection unit (or deviation detection device) 76, or the deviation detection means, and the aforementioned load adjustment unit (or load adjustment device) 77 are added to the functional block diagram for realizing the detection of fault described in connection with FIG. 6. It is added that the fault determination unit (or fault determination device) 75 and the load adjustment unit 77 may be made operational or their functions may be held in abeyance.

The deviation detection unit 76 determines that a deviation has occurred when the current displacement pattern calculated by the displacement pattern calculation unit 73 is different from the last or other previous displacement patterns stored in the storage unit 74.

When the deviation detection unit 76 has detected an abnormal displacement, for example as shown in FIG. 9A, FIG. 9B, FIG. 10A, or FIG. 10B, the operation of the fixing device 50 may be ceased or the value of the load F applied from the load adjustment unit 77 is adjusted for correcting the deviation of the heating belt 51.

When the operation of the fixing device 50 is to be ceased, the driving of the pressure roll 52 is stopped, for example, through the MPU 70. When the deviation of the heating belt 51 is to be corrected, adjustment is instructed to the load adjustment unit 77 through the MPU 70. As described above, one of the alignment adjustment unit 77A or the temperature adjustment unit 77B may be used in place of the load adjustment unit 77.

Accordingly, the magnetic permeability detection pattern 80 comprising metals having different thicknesses or different magnetic permeabilities is provided in an area of the heating belt 51 including the detection range (a) of the magnetic permeability sensor 60. Consequently, deviation of the heating belt 51 can be detected reliably. For example, a deficiency which had not been detected without a serious deviation of the heating belt 51 can now be detected in an early stage. As a result, load applied to the heating belt 51 can be reduced.

Further, when the fault determination unit 75 is made operational, the similar effects as those of the example of FIGS. 2 to 5, may also be obtained.

An example construction to enable detection, and an example method for detecting deviation of a heating belt used in an example fixing device will now be described with reference to the drawings. In the following, the same reference signs are used for the component parts or component elements described in the example of FIG. 7 to omit detailed explanations thereof.

Construction of Heating Belt

Figure 16A:
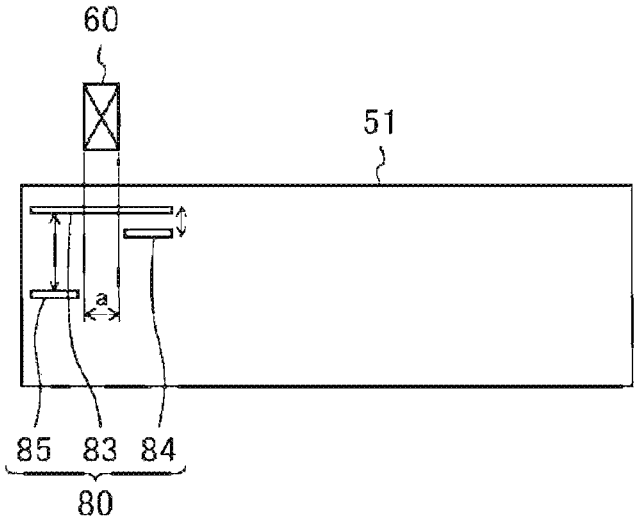
FIG. 16A is a plan view (developed view) of a case where magnetic permeability is detected in a normal belt position in an example fixing device.

FIG. 16A shows a planar construction of the example heating belt.

As shown in FIG. 16A, in the example heating belt 51, the magnetic permeability detection pattern 80 of metal is selectively arranged at one of the edges of the heating belt 51. Specifically, the example magnetic permeability detection pattern 80 is arranged to extend across the detection range (a) of the magnetic permeability sensor 60 and its periphery.

The example magnetic permeability detection pattern 80 may comprise, for example, a linear first metal chip 83, a linear second metal chip 84 facing (or aligned with) an inner end of the first metal chip 83 and a linear third metal chip 85 facing (or aligned with) an outer end of the first metal chip 83.

Then, as shown in FIG. 16A, the first metal chip 83 is located, with reference to the detection range (a) for magnetic permeability, to extend across the detection range (a) where there is no deviation of the belt, as well as either sides (to enable detection of deviation to the left or right) of the detection range (a). The second metal chip 84 is located in a region for detecting that the heating belt 51 is deviated to the left side and in a position at which it is cyclically offset from that of the first metal chip 83 in the direction of rotation of the belt. Further, the third metal chip 85 is located in a region for detecting that the heating belt 51 is deviated to the right side and in a position at which it is cyclically offset from those of the first metal chip 83 and the second metal chip 84.

Method for Detecting Deviation of Heating Belt

Figure 16B:
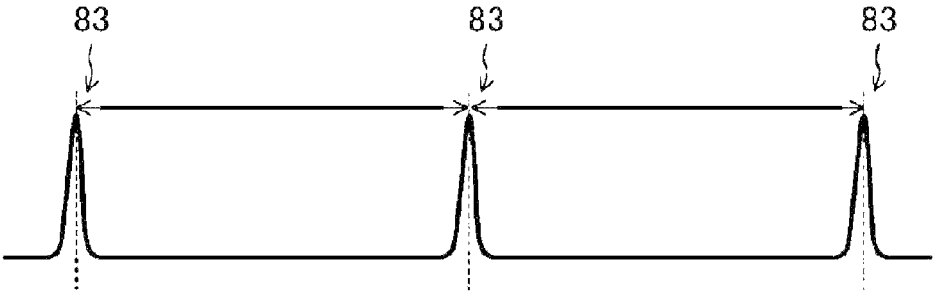
FIG. 16B is a diagrammatic graph showing a displacement pattern of magnetic permeability in that case.

As shown in FIG. 16B, when the heating belt 51 having the aforementioned constructions is rotated, the magnetic permeability of the magnetic permeability detection pattern 80 can be detected in a cycle attributable to the first metal chip 81.

Figure 17A:
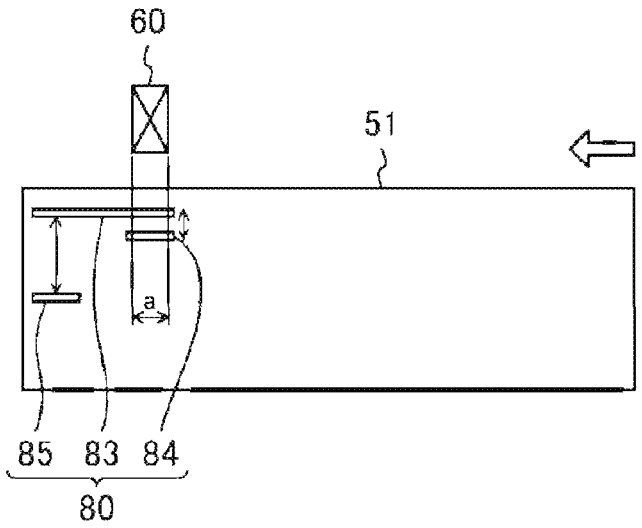
FIG. 17A is a plan view (developed view) of a case where magnetic permeability is detected in a belt position deviated to the right side in the example fixing device.
Figure 17B:
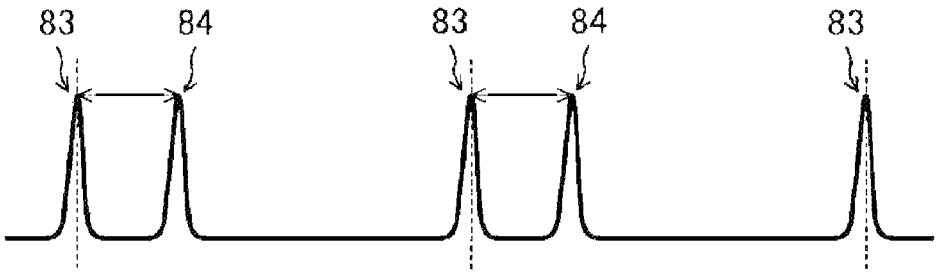
FIG. 17B is a diagrammatic graph showing a displacement pattern of magnetic permeability in that case.

On the other hand, as shown in FIG. 17A, when the heating belt 51 is deviated to the left side and the first metal chip 83 and the second metal chip 84 are both situated in the detection range (a) for magnetic permeability, the magnetic permeability is detected with two cycles attributable to the first metal chip 83 and the second metal chip 84, as shown in FIG. 17B. The detected two cycles of the magnetic permeability then indicate that the pertinent metal chips are the first metal chip 83 and the second metal chip 84, and determination can thus be made that the heating belt 51 is deviated to the left side.

Figure 18A:
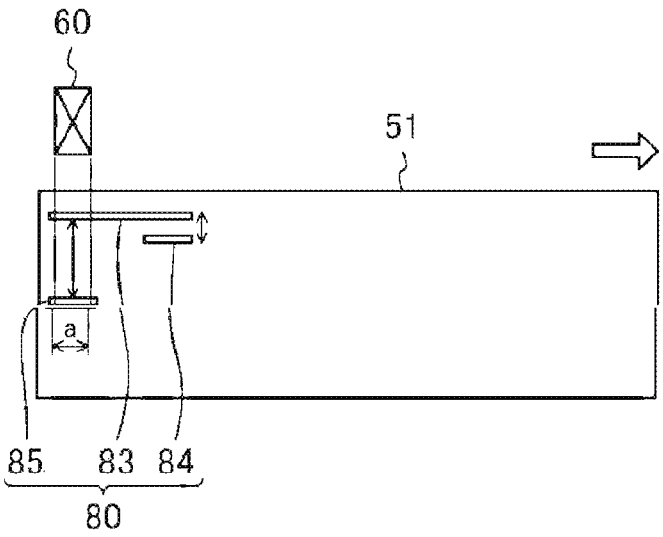
FIG. 18A is a plan view (developed view) of a case where magnetic permeability is detected in a belt position deviated to the left side in the example fixing device.
Figure 18B:
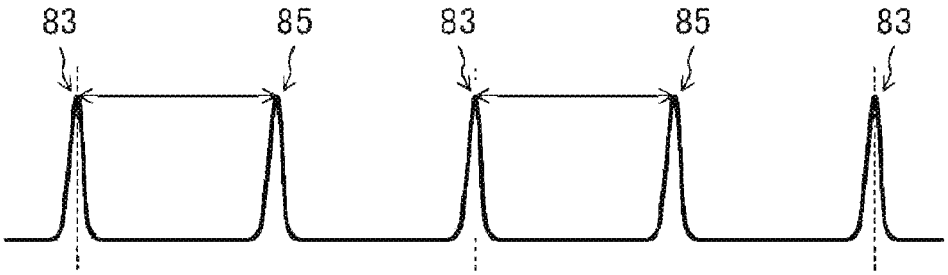
FIG. 18B is a diagrammatic graph showing a displacement pattern of magnetic permeability in that case.

Further, as shown in FIG. 18A, when the heating belt 51 is deviated to the right side and the first metal chip 83 and the third metal chip 85 are both situated in the detection range (a) for magnetic permeability, the magnetic permeability is detected with two cycles attributable to the first metal chip 83 and the third metal chip 85, as shown in FIG. 18B. The detected two cycles of the magnetic permeability then indicate that the pertinent metal chips are the first metal chip 83 and the third metal chip 85, and determination can thus be made that the heating belt 51 is deviated to the right side.

As described above, the example fixing device 50 is capable of ceasing the operation of the heating belt 51 based on a detected magnetic permeability. Further, a deviation to the left or to the right of the heating belt 51 can be corrected by providing load adjustment means such as the load adjustment unit 77.

In addition, a functional block diagram similar to the functional block diagram of FIG. 15 may also apply in the present example.

Modification in Construction of Heating Belt

In a modified example, in place of the construction of FIG. 16A, a metal sheet may be adhered entirely or partly between the first metal chip 83 and the second metal chip 84. Similarly, a metal sheet may be adhered entirely or partly between the first metal chip 83 and the third metal chip 85. Namely, the second metal chip 84 and the third metal chip 85 are increased in terms of area.

With the above construction, an abnormal displacement pattern generated upon the occurrence of deviation of the heating belt 51 appears not as a peak but as a trapezoidal area, and the detection of deviation may be facilitated thereby.

Accordingly, in an area of the heating belt 51 including the detection range (a) of the magnetic permeability sensor 60, the magnetic permeability detection pattern 80 of metal having a varying length in the direction of rotation is arranged along the widthwise direction of the heating belt 51. Consequently, deviation of the heating belt 51 can be detected reliably. For example, a deficiency which had not been detected without a serious deviation of the heating belt 51 can now be detected in an early stage. As a result, load applied to the heating belt 51 can be reduced.

Further, when the fault determination unit 75 is made operational, the same effects as those of the example of FIGS. 2 to 5.

It is to be understood that not all aspects, advantages and features described herein may necessarily be achieved by, or included in, any one particular example. Indeed, having described and illustrated various examples herein, it should be apparent that other examples may be modified in arrangement and detail.

What is claimed is:

1. A fixing device comprising:

a heating belt comprising an endless belt having a metal layer;

a heat source to heat the heating belt;

a pusher member located in a partial region inside the heating belt, the pusher member to abut the heating belt;

a pressing rotary body disposed to abut an outer peripheral surface of the heating belt at a position facing the pusher member to drive the heating belt, the pressing rotary body to capture a recording medium at a nip formed when the pressing rotary body is pressed against a surface of the pusher member to fix an image formed on the recording medium at the nip;

a magnetic permeability detection device located in a region spaced from the outer peripheral surface of the heating belt and facing the metal layer to detect a magnetic permeability of the heating belt;

a displacement pattern calculation device to calculate a current displacement pattern of magnetic permeability per perimeter of the heating belt based on variations in the magnetic permeability detected; and a fault determination device to compare the current displacement pattern with a previous displacement pattern having been previously calculated, the fault determination device to determine a fault when the current displacement pattern is different from the previous displacement pattern.

2. The fixing device according to claim 1, further comprising;

a processor to prompt an operation upon fault determination to be performed when the fault determination device determines the fault, wherein the operation upon fault determination comprises an operation to cease a driving of the heating belt.

3. The fixing device according to claim 2, wherein a magnetic permeability detection pattern of metal is selectively arranged on the heating belt in a detection range of the magnetic permeability detection device, wherein the fixing device further comprises a deviation detection device to detect the deviation of the heating belt when the current displacement pattern is different from the previous displacement pattern, and wherein the processor is to prompt an operation upon deviation detection to be performed when the deviation detection device detects that the deviation of the heating belt has exceeded a tolerance range of belt deviation.

4. A fixing device comprising:

a heating belt comprising an endless belt having a metal layer;

a heat source to heat the heating belt;

a pusher member located in a partial region inside the heating belt, the pusher member to abut the heating belt;

a pressing rotary body disposed to abut an outer peripheral surface of the heating belt at a position facing the pusher member to drive the heating belt, the pressing rotary body to capture a recording medium at a nip formed when the pressing rotary body is pressed against a surface of the pusher member, in order to fix an image formed on the recording medium at the nip; and a magnetic permeability detection device located in a region spaced from the outer peripheral surface of the heating belt and facing the metal layer to detect a magnetic permeability of the heating belt, wherein a magnetic permeability detection pattern of metal is selectively arranged on the heating belt in a detection range of the magnetic permeability detection device, and wherein, when it is determined that an amount or a cycle of variation of the magnetic permeability of the heating belt has deviated from a respective predetermined range or cycle during rotation, the pressing rotary body ceases a driving of the heating belt.

5. The fixing device according to claim 4, wherein the magnetic permeability detection pattern of metal includes a pattern having a varying thickness in a widthwise direction of the heating belt.

6. The fixing device according to claim 4, wherein the magnetic permeability detection pattern of metal includes a pattern having a varying spacing or area in a widthwise direction of the heating belt.

7. The fixing device of according to claim 4, further comprising:

a displacement pattern calculation device to calculate a current displacement pattern of magnetic permeability per perimeter of the heating belt based on variations in the magnetic permeability detected;

a deviation detection device to compare the current displacement pattern with a previous displacement pattern having been previously calculated, the deviation detection device to detect a deviation of the heating belt when the current displacement pattern is different from the previous displacement pattern;

a processor to prompt an operation upon deviation detection, to be performed when the deviation detection device detects that the deviation of the heating belt has exceeded a tolerance range of belt deviation; and a deviation correction device to correct the deviation of the heating belt when the deviation detection device determines that the amount or the cycle of variation of the magnetic permeability of the heating belt has deviated from the predetermined range.

8. The fixing device according to claim 7, wherein the deviation correction device includes a load adjustment device to adjust, in a direction in which the heating belt faces the pressing rotary body, a load applied to at least one of support members that support edges of the heating belt.

9. The fixing device according to claim 7, wherein the deviation correction device includes an alignment adjustment device to adjust an alignment position between a center of rotation of the heating belt and a rotation axis of the pressing rotary body by applying pressure to one of support members that support edges of the heating belt.

10. The fixing device according to claim 7, wherein the deviation correction device includes a temperature adjustment device to locally adjust a temperature of the heating belt.

11. A fixing device comprising:

a heat source;

a heating belt comprising an endless belt;

a magnetic permeability detection pattern arranged on the heating belt and a magnetic permeability detection device located adjacent the heating belt to detect a magnetic permeability from the magnetic permeability detection pattern, wherein the magnetic permeability detection pattern has a varying thickness, spacing, or area in a widthwise direction of the heating belt.

12. The fixing device according to claim 11, further comprising:

a displacement pattern calculation device to calculate a current displacement pattern of magnetic permeability per perimeter of the heating belt based on variations in the magnetic permeability detected;

an anomaly determination device to compare the current displacement pattern with a previous displacement pattern having been previously calculated, the anomaly determination device to determine an anomaly in the heating belt when the current displacement pattern is different from the previous displacement pattern; and a processor to prompt an operation to be performed on the heating belt when the anomaly determination device determines the anomaly, wherein the anomaly determination device comprises a fault determination device to determine a structural anomaly in the heating belt, and wherein the operation to be performed comprises ceasing an operation of the heating belt.

13. The fixing device according to claim 11, further comprising:

a displacement pattern calculation device to calculate a current displacement pattern of magnetic permeability per perimeter of the heating belt based on variations in the magnetic permeability detected;

an anomaly determination device to compare the current displacement pattern with a previous displacement pattern having been previously calculated, the anomaly determination device to determine an anomaly in the heating belt when the current displacement pattern is different from the previous displacement pattern; and a processor to prompt an operation to be performed on the heating belt when the anomaly determination device determines the anomaly, wherein the anomaly determination device comprises a deviation detection device to detect a deviation of the heating belt, and wherein the operation to be performed comprises correcting an alignment of the heating belt.

14. The fixing device according to claim 11, wherein the magnetic permeability detection pattern is arranged on the heating belt at an edge of the heating belt.

15. The fixing device according to claim 11, wherein the magnetic permeability detection pattern comprises:

a first chip; and a second chip, wherein a thickness or a magnetic permeability of the first chip is different from a thickness or a magnetic permeability of the second chip, respectively.

16. The fixing device according to claim 11, wherein the magnetic permeability detection pattern comprises:

a linear first metal chip;

a linear second metal chip aligned with an inner end of the linear first metal chip; and a linear third metal chip aligned with an outer end of the linear first metal chip.

* * * * *